US005292361A

United States Patent [19]

Otsuka et al.

[11] Patent Number: 5,292,361

[45] Date of Patent: Mar. 8, 1994

[54] ELECTROLESS PALLADIUM PLATING COMPOSITION

[75] Inventors: Kuniaki Otsuka, Osaka; Eiichi Torikai, Yao; Shigemitsu Kawagishi, Suita; Kazuyoshi Okuno, Ashiya, all of Japan

[73] Assignee: Okuno Chemical Industries Co., Ltd., Osaka, Japan

[21] Appl. No.: 923,097

[22] Filed: Jul. 30, 1992

[30] Foreign Application Priority Data

Aug. 2, 1991 [JP] Japan ..... 3-194451

[51] Int. Cl.[5] ..... C23C 18/44

[52] U.S. Cl. ..... 106/1.28; 106/1.05

[58] Field of Search ..... 106/1.05-1.28; 427/304, 443.1

[56] References Cited

U.S. PATENT DOCUMENTS 4,248,632 2/1981 Ehrich et al. ..... 106/1.11

5,158,604 10/1992 Morgan et al. ..... 106/1.23

FOREIGN PATENT DOCUMENTS 26764 8/1971 Japan .

37045 10/1978 Japan ..... C23C 3/02

124280 6/1987 Japan ..... C23C 18/44

*Primary Examiner*—Helene Klemanski

*Assistant Examiner*—Margaret Einsmann

*Attorney, Agent, or Firm*—Knobbe Martens Olson & Bear

[57] ABSTRACT

An electroless palladium plating composition which comprises (1) 0.001-0.1 mol/l of a palladium compound, (2) 0.01-1 mol/l of a hypophosphite compound, (3) 0.01-5 mol/l of at least one member selected from the group consisting of ammonia and alkylamine compounds, (4) 0.01-20 mg/l of high-molecular weight polyethyleneimine having molecular weight of 300 to 100000 and (5) 0.01-10 g/l of an aliphatic alkyenylamine, and which is used at a pH in the range of 5-10.

5 Claims, 1 Drawing Sheet

ELECTROLESS PALLADIUM PLATING COMPOSITION

FIELD OF THE INVENTION

The present invention relates to a composition for electroless palladium plating.

BACKGROUND OF THE INVENTION

Since noble metals or alloys thereof are stable in electrical characteristics and highly resistant to corrosion and abrasion, they have been widely used, for example as materials for contacts of electronic components. Industrially, noble metals are chiefly used for electroplating, particularly gold electroplating, the gold plating involving high costs. High density surface mounting technology is the mainstream in the field of printed board production. In this technology, a surface mounted substrate is generally prepared by plating a copper circuit with gold. However, since gold plating diffuses with copper in soft soldering, the copper circuit must be pretreated with electroless nickel plating, which leads to complicated preparation process and lower productivity. In view of the above problems, the use of palladium electroplating in place of gold electroplating is on the increase.

However, the substitution of palladium for gold leaves another problem to be solved. Since a palladium plating formed according to the foregoing electroplating technology is not uniform in thickness, it comes to be inapplicable to recent high technology, e.g. more miniaturized and complicated electrical components. In contrast, according to electroless plating technology, a uniform plating layer can be deposited on electrical components having minute and complex configuration. Consequently, there have been proposed a lot of methods of electroless noble metal plating, particularly electroless palladium plating which has an advantage of lower costs over gold or platinum plating.

Compositions widely used for electroless palladium plating are, for example, a composition comprising a bivalent palladium salt, ammonia, ethylenediaminetetraacetate salt and hydrazine and a composition comprising a bivalent palladium salt, ethylenediamine, ethylenediaminetetraacetate salt and sodium hypophosphite (disclosed in Japanese Examined Patent Publication No. 26764/1971). However, these plating compositions are unstable in baths and decomposed in a short period of time. To improve the bath stability, methods comprising adding a bivalent sulfur-containing organic compound have been proposed in Japanese Examined Patent Publications No. 37045/1978 and Japanese Unexamined Patent Publication No. 124280/1987, etc.

However, according to the above organic compound-adding methods, considerably strong internal stress occurs in the plating layer deposited and is likely to cause cracks therein, which makes thick plating difficult or impossible. Under these circumstances, the development of an electroless palladium plating composition which is usable in an industrial scale is eagerly waited for in electronic industry and other fields.

SUMMARY OF THE INVENTION

The purpose of the present invention is to provide a composition for electroless palladium plating which can be used in an industrial scale.

In view of the above problems, the present inventors carried out extensive research and found that an electroless palladium composition containing high-molecular weight polyethyleneimine having molecular weight of 300 to 100,000 and an aliphatic alkenyl amine exhibits a good bath stability and enables the formation of a uniform, minute and close palladium plating while suppressing or preventing the occurrence of internal stress in the plating. The present invention has been accomplished based on this novel finding.

Stated more specifically, the present invention provides an electroless palladium plating composition which comprises (1) 0.001–0.1 mol/l of a palladium compound, (2) 0.01–1 mol/l of a hypophosphite compound, (3) 0.01–5 mol/l of at least one member selected from the group consisting of ammonia and alkylamine compounds, (4) 0.01–20 mg/l of high-molecular weight polyethyleneimine having molecular weight of 300 to 100,000 and (5) 0.01–10 g/l of aliphatic alkenyl amine, and which is used at a pH in the range of 5–10.

The present invention will be described below in detail.

DETAILED DESCRIPTION OF THE INVENTION

Examples of palladium compounds useful in the invention include known compounds such as palladium oxide, palladium chloride, palladium nitrate, palladium acetate, sodium palladium chloride, potassium palladium chloride, ammonium palladium chloride, palladium sulfate, tetraammine palladium chloride, dinitrodiammine palladium and like palladium compounds. The concentration of the palladium compound in the plating composition of the invention is in the range of 0.001 to 0.1 mol/l, preferably 0.003 to 0.05 mol/l. When the concentration is lower than 0.001 mol/l, the deposition rate is lowered and thus leads to lower productivity, whereas when the concentration is higher than 0.1 mol/l, the plating composition becomes unstable, hence undesirable.

Examples of hypophosphite compounds useful in the invention include known compounds such as hypophosphorous acid, ammonium hypophosphite, potassium hypophosphite, sodium hypophosphite, lithium hypophosphite, calcium hypophosphite and like hypophosphite compounds. The hypophosphite compound acts as a reducing agent for palladium ions in the plating composition of the invention. The concentration of the hypophosphite compound in the plating composition of the invention is in the range of 0.01 to 1 mol/l, preferably 0.05 to 0.5 mol/l. When the concentration is lower than 0.01 mol/l, the deposition rate is lowered, whereas when the concentration is higher than 1 mol/l, the plating composition becomes unstable, hence undesirable.

Examples of alkylamine compounds for use in the invention include widely used compounds; such as methylamine, ethylamine, propylamine, dimethylamine, trimethylamine, methylethylamine, isopropylamine and like monoamines; methylenediamine, ethylenediamine, propylenediamine, butylenediamine and like diamines; dimethylene triamine, diethylene triamine, triethylenetetramine, tetraethylenepentamine, pentaethylenehexamine and like polyamines; ethylenediaminetetraacetic acid, diethylenetriaminepentacetic acid, N-hydroxyethylethylenediaminetriacetic acid, nitrilotriacetic acid and alkali metal salts thereof; glycine, N-methylglycine and like amino acids. At least one member selected from the group consisting of alkylamine compounds and ammonia is added to the plating composition so that palladium-complexes can be formed to stabilize palladium in the plating solution. The concentration of the alkylamine compound and ammonia in the plating composition of the invention is in the range of 0.01 to 5 mol/l, preferably 0.05 to 3 mol/l. The use of the alkylamine compound in a concentration lower than 0.01 mol/l makes the plating composition unstable, whereas the use thereof in a concentration higher than 5 mol/l stabilizes the plating composition but lowers the deposition rate and increases costs, hence undesirable. At least two compounds selected from ammonia and alkylamine compounds can be used in combination insofar as total concentration thereof is within the above-mentioned range.

High-molecular weight polyethyleneimine to be used in the invention has a molecular weight of 300 to 100,000 (polymerization degree 8 to 2350), preferably 600 to 70,000 (polymerization degree 14 to 1600). Polyethyleneimine having a molecular weight of less than 300 has an insufficient effect on the stabilization of the plating composition, whereas polyethyleneimine having a molecular weight of more than 100,000 makes the plating composition so stable as to lower the deposition rate, hence undesirable. High-molecular weight polyethyleneimine of the invention may be a complete linear polymer or a polymer containing tertiary amine which branches off at nitrogen in the molecule. These polymers can be used simply or in combination thereof. The concentration of the high-molecular weight polyethyleneimine in the plating composition of the invention is in the range of 0.01 to 20 mg/l. The use of the polyethyleneimine in a concentration lower than 0.01 mg/l produces an insufficient effect on the stabilization of the plating composition, whereas the use thereof in a concentration higher than 20 mg/l lowers the deposition rate, hence undesirable.

Examples of aliphatic alkenylamides unsaturated alkylamines useful in the invention include known compounds such as monovinylamine, divinylamine, monoallylamine, diallylamine, propenylamine, isopropenylamine, and like monoamines; N-monovinylethylenediamine, N-monoallylethylenediamine, N,N'-diallylethylenediamine, N-isopropenylethylenediamine and like diamines; N-allyldiethylenetriamine, N,N'-diallyldiethylenetriamine, N-vinyltriethylenetetramine and like polyamines. These aliphatic alkenylamines can be used simply or in combination thereof. The concentration of the unsaturated alkylamine in the plating composition of the invention is in the range of 0.01 to 10 g/l, preferably 0.1 to 5 g/l. The use of aliphatic alkenylamines in a concentration lower than 0.01 g/l produces an insufficient effect on the stabilization of the plating composition, whereas the use thereof in a concentration higher than 10 g/l contributes to stabilization of the plating composition but is uneconomical. Therefore, the concentration of lower than 0.01 g/l or higher than 10 g/l is undesirable. The unsaturated alkylamine of the invention may be partially hydrolyzed into an amine and an aldehyde or a ketone compound in the plating composition.

An electroless palladium plating composition of the invention comprising said ingredients is usually usable at a wide range of temperature, i.e., about 25° to 80° C., preferably about 35° to 70° C. When the temperature is lower than 25° C., the deposition rate is lowered, hence not practical. When the temperature is higher than 80° C., the deposition rate is increased but the plating composition becomes unstable, hence undesirable.

The plating composition of the invention is used at a pH in the range of 5 to 10, preferably 5.5 to 9. When the pH is lower than 5, the stability of palladium-amine complexes in the plating composition is lowered, whereas when the pH is higher than 10, a reducing agent acts so strongly as to make the plating composition unstable, hence undesirable. The pH of the plating composition can be adjusted by a usual method using an acid solution such as hydrochloric acid and sulfuric acid or an alkaline solution such as sodium hydroxide.

When an electroless palladium plating composition of the invention is applied to metals such as Fe, Ni, Au, Ag, Pt, Ru, Rh and Pd or alloys thereof, a plating layer is autocatalitically deposited on the metals or alloys by simply immersing them in the plating composition. When the composition is applied to non-catalytic materials such as resins, ceramics and glasses, the materials are catalyzed by a sensitizing-activating method or characterizing-accelerating method to autocatalytically deposit a plating layer on the materials.

Electroless palladium plating composition of the invention has the following excellent properties.

(1) Since electroless palladium plating composition of the invention has excellent stability, the composition is usable over a long period by simply supplementing ingredients of the composition used in plating formation such as palladium and a reducing agent.

(2) Since electroless palladium plating composition of the invention is autocatalytic, a plating layer of any thickness can be formed.

(3) Since electroless palladium plating composition of the invention is usable in a wide range of pH, particularly in the range around neutral, the composition is applicable to various materials such as alkaline soluble resist-coated substrates and polyester resins which are likely to deteriorate in alkali.

(4) Since substantially no internal stress occurs in the plating formed, the plating exhibits an excellent adhesion property and no cracks occur even in a film thicker than 10 μm. Furthermore, the foregoing plating, which has minute and close structure and high corrosion resistance, is the most suitable coating for contacts of electrical components.

(5) Since the film formed has excellent solderability just like gold and does not diffuse with copper unlike gold diffusing with copper, direct plating on a copper circuit is possible in the manufacture of surface mounted substrates, etc., so that simplification of the manufacturing process, higher productivity and more economical process can be accomplished.

EXAMPLE

Given below are Examples to clarify the features of the present invention in greater detail.

EXAMPLE 1

Plating compositions of the invention (Nos.1–13) were prepared by incorporating ingredients in the ratios given in Table 1 and placed in baths. Plating was carried out in each of the plating baths and the films formed and baths were evaluated. The results are shown in Table 1.

Copper sheets (2 cm×2 cm×0.03 cm) were used as substrates for plating. Plating treatment consists of the following steps. Copper sheets were immersed in an aqueous solution of 50 g/l of an alkali degreasing agent (trademark "OPC-250 Cleaner M", product of Okuno Chemical Industry Co., Ltd.) at 60° C. for 5 minutes for degrease of the copper plate, then washed with water, further immersed in an aqueous solution of 200 mg/l of an activating reagent (trademark "ICP Accera", product of Okuno Chemical Industry Co., Ltd.) at 25° C. for 1 minute for activation of the copper plate, thereafter washed with water and finally immersed in 1 l of respective plating compositions (Nos. 1–13) to carry out plating. The copper sheets were rocked with an amplitude of 5 cm at the speed of 2 m/min for agitation during plating treatment.

Stability of each plating bath was evaluated by checking each plating bath which had been allowed to stand at 80° C. for 100 hours.

Solderability of each plating was evaluated according to a usual menisco-graph method. Stated more specifically, copper sheet test pieces (1 cm×5 cm×0.03 cm) were subjected to the foregoing electroless palladium plating treatment to form films of 1 μm thickness thereon and then immersed in rosin flux (a solution of 350 g of resin in 1 l of isopropyl alcohol) for 10 seconds. Subsequently, using a solder checker (product of Lesca Co. Ltd.), the test pieces were immersed 2 mm deep in a melted solder (6/4 solder (Sn:Pb=6:4)) at 230° C. for 10 seconds to check zero-cross time, i.e., a time gap between starting time of the immersion and time when the contact angle of respective specimens with the solder became 90°. Solderability of each piece was evaluated in terms of the zero-cross time.

The occurrence of cracks was determined by examining the films formed by three consecutive hour plating under an electron microscope with a magnification of 4,000.

For comparison, other plating baths (Nos. 14–21) were made of compositions containing neither unsaturated alkylamine nor high-molecular weight polyethyleneimine, compositions containing only one of the above two ingredients and compositions containing known sulfuric additives. The films formed and baths were evaluated in the same manner as described above. The results are shown in Table 1.

TABLE 1

| | Composition of the present invention | | | | | | | | |
|---|---|---|---|---|---|---|---|---|---|
| | 1 | 2 | 3 | 4 | 5 | 6 | 7 | 8 | 9 |
| Electroless palladium plating composition | | | | | | | | | |
| Pd salt | | | | | | | | | |
| $PdCl_2$ (mol/l) | 0.1 | 0.005 | | | 0.01 | 0.02 | 0.03 | | |
| $Pd(NH_3)_2(NO_2)_2$ (mol/l) | | | 0.008 | 0.015 | | | | 0.02 | 0.01 |
| Reducing agent | | | | | | | | | |
| $NaH_2PO_2$ (mol/l) | 0.1 | 0.2 | | | 0.1 | | 0.05 | 0.08 | 0.2 |
| $NH_4H_2PO_2$ (mol/l) | | | 0.3 | 0.5 | | 0.1 | | | |
| alkylamine or ammonia | | | | | | | | | |
| Ethylenediamine (mol/l) | 0.1 | | | | | | | 0.1 | 0.1 |
| Propylenediamine (mol/l) | | 0.5 | | | | | | | |
| Diethylenetriamine (mol/l) | | | 0.3 | | | | | | |
| Pentaethylenehexamine (mol/l) | | | | 0.8 | | | | | |
| Ethylenediaminetetraacetic acid (mol/l) | | | | | 0.01 | | | 0.02 | |
| Glycine (mol/l) | | | | | | 0.05 | | | |
| Ammonia (mol/l) | | | | | | | 3.0 | | 1.0 |
| Polyethyleneimine | | | | | | | | | |
| Molecular weight of 600 (mg/l) | 1.0 | | | | | 2.0 | | 10.0 | |
| Molecular weight of 3,000 (mg/l) | | 3.0 | | | | | | | 3.0 |
| Molecular weight of 10,000 (mg/l) | | | 5.0 | | | | | | |
| Molecular weight of 70,000 (mg/l) | | | | 0.1 | 1.0 | | 3.0 | | |
| aliphatic alkenylamine | | | | | | | | | |
| Monoallylamine (g/l) | 1.0 | | | 5.0 | | | 0.5 | 0.3 | |
| Isopropenylamine (g/l) | | 0.1 | | | 10.0 | | | | 1.0 |
| Monovinylamine (g/l) | | | 0.3 | | | 5.0 | | | |
| 2-mercaptobenzimidazol (mg/l) | | | | | | | | | |
| Thiodiglycolic acid (mg/l) | | | | | | | | | |
| Temperature (°C.) | 60 | 60 | 60 | 60 | 60 | 60 | 60 | 60 | 70 |
| pH | 8.0 | 8.0 | 8.0 | 8.0 | 5.5 | 7.0 | 8.0 | 9.0 | 8.0 |
| Plating film | | | | | | | | | |
| Deposition rate (μm/hour) | 2.0 | 1.0 | 1.6 | 1.9 | 0.9 | 2.1 | 2.5 | 2.2 | 1.9 |
| Appearance of plating | Good | Good | Good | Good | Good | Good | Good | Good | Good |
| Cracks (checked after 3-hour plating) | None | None | None | None | None | None | None | None | None |
| Zero-cross time (second) | 2.9 | 3.1 | 3.4 | 2.9 | 3.0 | 3.5 | 3.4 | 3.1 | 3.5 |
| Bath stability (80° C.-100 hours later) | Good | Good | Good | Good | Good | Good | Good | Good | Good |

| | Composition of the present invention | | | | Comparative Example (No.) | | |
|---|---|---|---|---|---|---|---|
| | 10 | 11 | 12 | 13 | 14 | 15 | 16 |
| Electroless palladium plating composition | | | | | | | |
| Pd salt | | | | | | | |
| $PdCl_2$ (mol/l) | | | | | 0.01 | 0.01 | 0.01 |
| $Pd(NH_3)_2(NO_2)_2$ (mol/l) | 0.02 | 0.05 | 0.01 | 0.01 | | | |
| Reducing agent | | | | | | | |
| $NaH_2PO_2$ (mol/l) | 0.05 | | | | 0.1 | 0.1 | 0.1 |
| $NH_4H_2PO_2$ (mol/l) | | 0.05 | 0.1 | 0.15 | | | |
| alkylamine or ammonia | | | | | | | |
| Ethylenediamine (mol/l) | | | | 0.1 | 0.1 | 0.1 | 0.1 |

TABLE 1-continued

| | | | | | | | |
|---|---|---|---|---|---|---|---|
| Propylenediamine (mol/l) | 0.1 | | | | | | |
| Diethylenetriamine (mol/l) | | 0.1 | | | | | |
| Pentaethylenehexamine (mol/l) | | | 0.1 | 0.1 | | | |
| Ethylenediaminetetraacetic acid (mol/l) | | | 0.01 | 0.05 | | | 0.01 |
| Glycine (mol/l) | 0.01 | 0.02 | | | | | |
| Ammonia (mol/l) | | | | | | | |
| Polyethyleneimine | | | | | | | |
| Molecular weight of 600 (mg/l) | | | 0.5 | | | | |
| Molecular weight of 3,000 (mg/l) | | | | 0.5 | | | |
| Molecular weight of 10,000 (mg/l) | 1.0 | | | 0.5 | | | |
| Molecular weight of 70,000 (mg/l) | | 2.0 | 0.5 | | | | |
| aliphatic alkenylamine | | | | | | | |
| Monoallylamine (g/l) | | 0.2 | | 0.2 | | | |
| Isopropenylamine (g/l) | | 0.2 | 0.2 | | | | |
| Monovinylamine (g/l) | 2.0 | | 0.2 | 0.2 | | | |
| 2-mercaptobenzimidazol (mg/l) | | | | | | 10.0 | |
| Thiodiglycolic acid (mg/l) | | | | | | | 300 |
| Temperature (°C.) | 50 | 40 | 60 | 60 | 60 | 60 | 60 |
| pH | 8.0 | 8.0 | 5.5 | 6.0 | 8.0 | 8.0 | 8.0 |
| Plating film | | | | | | | |
| Deposition rate (μm/hour) | 2.0 | 2.5 | 1.9 | 2.1 | 2.1 | 1.8 | 3.0 |
| Appearance of plating | Good | Good | Good | Good | Good | Ununiform | Ununiform |
| Cracks (checked after 3-hour plating) | None | None | None | None | None | Occurred | Occurred |
| Zero-cross time (second) | Good 3.4 | Good 3.4 | Good 3.2 | Good 3.1 | 3.3 | 5.1 | 4.8 |
| Bath stability (80° C.-100 hours later) | Good | Good | Good | Good | Decomposed | Good | Good |

| | Comparative Example (No.) | | | | |
|---|---|---|---|---|---|
| | 17 | 18 | 19 | 20 | 21 |
| Electroless palladium plating composition | | | | | |
| Pd salt | | | | | |
| $PdCl_2$ (mol/l) | 0.01 | | 0.02 | 0.01 | 0.01 |
| $Pd(NH_3)_2(NO_2)_2$ (mol/l) | | 0.01 | | | |
| Reducing agent | | | | | |
| $NaH_2PO_2$ (mol/l) | | 0.05 | 0.2 | 0.1 | 0.1 |
| $NH_4H_2PO_2$ (mol/l) | 0.1 | | | | |
| alkylamine or ammonia | | | | | |
| Ethylenediamine (mol/l) | 0.1 | | 0.2 | 0.1 | 0.1 |
| Propylenediamine (mol/l) | | 0.5 | | | |
| Diethylenetriamine (mol/l) | | | | | |
| Pentaethylenehexamine (mol/l) | | | | | |
| Ethylenediaminetetraacetic acid (mol/l) | | | 0.1 | | |
| Glycine (mol/l) | 0.05 | | | | |
| Ammonia (mol/l) | | 3.0 | | | |
| Polyethyleneimine | | | | | |
| Molecular weight of 600 (mg/l) | | 2.0 | | 1.0 | 1.0 |
| Molecular weight of 3,000 (mg/l) | | | | | |
| Molecular weight of 10,000 (mg/l) | | | | | |
| Molecular weight of 70,000 (mg/l) | | | | | |
| aliphatic alkenylamine | | | | | |
| Monoallylamine (g/l) | | | 1.0 | 1.0 | 1.0 |
| Isopropenylamine (g/l) | | | | | |
| Monovinylamine (g/l) | | | | | |
| 2-mercaptobenzimidazol (mg/l) | | | | | |
| Thiodiglycolic acid (mg/l) | | | | | |
| Temperature (°C.) | 60 | 60 | 60 | 60 | 60 |
| pH | 6.0 | 11.0 | 8.0 | 11.0 | 4.0 |
| Plating film | | | | | |
| Deposition rate (μm/hour) | 2.1 | 1.8 | 3.0 | 2.5 | 2.1 |
| Appearance of plating | Good | Ununiform | Good | Ununiform | Good |
| Cracks (checked after 3-hour plating) | None | Occurred | None | Occurred | None |
| Zero-cross time (second) | 3.3 | 5.8 | 3.3 | 5.7 | 3.8 |
| Bath stability (80° C.-100 hours later) | Decomposed | Decomposed | Decomposed | Decomposed | Decomposed |

The results are summarized as follows. When electroless palladium plating compositions of the invention were used, the films formed had nice gloss and exhibited a good adhesion property in a folding test. After three consecutive hour plating, the plating films kept glossy and no cracks were observed under the electron microscope. Furthermore, the stability of the plating baths did not change, i.e., the plating compositions were stable. In contrast, when compositions Nos. 14–21 were used, all the plating baths except sulfuric additive-containing ones showed insufficient stability, i.e., all decomposed when they were allowed to stand at 80° C. for 100 hours. Although the sulfuric additive-containing plating baths were stable, cracks were observed in the films when plating continued for three hours.

It is clear from the above that the use of the plating composition of the invention is the key to good bath stability and crackless plating film formation.

EXAMPLE 2

The same electroless palladium plating composition as in Example (No. 1 in Table was used to form thick electroless palladium plating films. Copper sheets (2 cm×2 cm×0.03 cm) were used as test pieces. The same plating treatment and conditions as in Example 1 were used except that the plating baths were divided in two and kept one at 50° C. and the other at 60° C. The results are shown in FIG. 1.

For comparison, conventional electroless palladium compositions (Nos. 14 and 15 in Table 1) were used to form thick plating films in the same manner as mentioned above. The results are shown in FIG. 1.

The results are summarized as follows. When the electroless palladium composition of the invention was used, deposition rates were 1.3 μm/hour at 50° C. and 2.0 μm at 60° C., i.e., the higher the temperature is, the higher the deposition rate is. The films had nice gloss and showed a good adhesion property in a folding test. The plating films became thicker as time passed. When plating continued for seven hours, the films kept glossy and no cracks were observed under the electron microscope.

The results in the comparative plating baths Nos. 14 and 15 strikingly contrast with the above results. Since plating bath No. 14 was unstable and decomposed in 3.5 hours, a film thicker than about 6 μm could not be formed. Although the stability of the plating bath No. 15 was relatively good, cracks were observed when plating continued for more than 3 hours. Consequently, a film thicker than 5 μm could not be formed.

It is clear from the above that when the electroless palladium plating composition of the invention is used, plating deposition continues for a long period of time due to the excellent bath stability. Moreover, since the plating formed is substantially free of internal stress, a crackless film thicker than 10 μm can be formed.

EXAMPLE 3

Using the same electroless palladium plating composition as in Example 1 (No. 1 of Table 1), electroless palladium plating films were formed on four different materials other than copper: a steal plate, an electroless nickel-plated plate, ABS resin and alumina ceramics. In FIG. 2, graphs show the relation between plating time and thickness of the plating layer deposited on each substrate material.

A cold rolled steel plate (2 cm×5 cm×0.03 cm) was used as a substrate and first degreased by the immersion thereof in an aqueous solution of 50 g/l of an alkali degreasing agent (trademark "OPC-250 Cleaner M", product of Okuno Chemical Industry Co., Ltd.) at 60° C. for 5 minutes and thereafter by cathode electrolysis (1 A/dm$^2$) in an aqueous solution of 100 g/l of an electrolytic degreasing agent (trademark "Ace Clean MK", product of Okuno Chemical Industry Co., Ltd.) at 60° C. for 1 minute. Next, the steel plate was washed with water, then immersed in an aqueous solution of 100 mg/l of 36% hydrochloric acid for 1 minute for activation and thereafter washed with water. Finally an electroless palladium plating of the invention was formed on the steel plate. The steel plate was rocked with an amplitude of 5 cm at the speed of 2 m/min for agitation during plating treatment.

An electroless nickel-plated plate (2 cm×5 cm×0.03 cm) was used as a test piece and an electroless palladium plating was formed thereon by the same plating treatment and conditions as in the above steel plate plating. The electroless nickel-plated plate was prepared as follows. A copper sheet (2 cm×5 cm×0.03 cm) was immersed in an aqueous solution of 50 g/l of an alkali degreasing agent (trademark "OPC-250 Cleaner M", product of Okuno Chemical Industry Co., Ltd.) at 60° C. for 5 minutes for degrease, then washed with water, further immersed in an aqueous solution of 200 mg/l of an activating reagent (trademark "ICP Accera", product of Okuno chemical Industry Co., Ltd.) at 25° C. for 1 minute for activation, thereafter washed with water and finally immersed in an electroless nickel plating composition (trademark "ICP Nicoron U", product of Okuno Chemical Industry Co., Ltd.) at 85° C. for 30 minutes to form an electroless nickel plating film of about 5 μm thickness thereon.

ABS resin plate (2 cm×5 cm×0.3 cm) was used as a test piece, first immersed in an aqueous solution of 50 g/l of an alkali degreasing agent (trademark "OPC-250 Cleaner M", product of Okuno Chemical Industry Co., Ltd.) at 60° C. for 5 minutes for degrease, then washed with water, further immersed in an etching solution (an aqueous solution of 400 g/l of chromic acid anhydride and 400 ml/l of 98% sulfuric acid) at 70° C. for 5 minutes for surface roughening and thereafter washed with water. Subsequently the resin was immersed in an aqueous solution of 100 mg/l of 36% hydrochloric acid at room temperature for minute for removing of chromic acid, then washed with water, further immersed in a standard bath of a catalyst solution (trademark "A-30 Catalyst", product of Okuno Chemical Industry Co., Ltd.) at room temperature for 3 minutes for catalyst impartation and thereafter washed with water. Subsequently, the resin was immersed in an aqueous solution of 100 mg/l of an activating agent (trademark "OPC-500 Accelerator", product of Okuno Chemical Industry Co., Ltd.) at 35° C. for 5 minutes for activation, then washed with water and finally immersed in the electroless palladium plating composition of the invention at 60° C. to form a plating film thereon. The resin was rocked with an amplitude of 5 cm at the speed of 2 m/min for agitation during plating treatment.

Alumina ceramics plate (2 cm×5 cm×0.1 cm) was used as a test piece, first immersed in an aqueous solution of 50 g/l of an alkali degreasing agent (trademark "OPC-250 Cleaner M", product of Okuno Chemical Industry Co., Ltd.) at 60° C. for 5 minutes for degrease, then washed with water and thereafter immersed in an etching solution (an aqueous solution of 250 g/l of an acidic ammonium fluoride) at room temperature for 5 minutes for surface roughening. After ultrasonic cleaning with water, the plate was immersed in an aqueous solution of 200 mg/l of a sensitizer (trademark "Sensitizer", product of Okuno Chemical Industry Co., Ltd.) at room temperature for 3 minute for sensitization, then washed with water, thereafter immersed in an aqueous solution of 50 mg/l of an activating agent (trademark "Activator", product of Okuno Chemical Industry Co., Ltd.) at room temperature for 3 minutes for activation, then washed with water and finally immersed in of the electroless palladium plating composition of the invention at 60° C. to form a plating film thereon. The plate was rocked with an amplitude of 5 cm at the speed of 2 m/min for agitation during plating treatment.

The results are summarized as follows. The rates of deposition on the steal plate, electroless nickel-plated plate, ABS resin plate and alumina ceramics plate were 1.9 μm/hour, 1.7 μm/hour, 2.1 μm/hour and 1.9 μm/hour respectively. The films on all of the above plates became thicker as time passed; the increase in thickness is in direct proportion to the plating time. Even when plating continued for seven hours, films had nice gloss and no cracks were observed.

It is clear from the above that the electroless palladium plating composition of the invention enables the formation of an excellent plating film which exhibits good adhesion to nonmetallic materials (insulators) such as resin and ceramics as well as to metals such as nickel and steel and which is free of cracks.

Figure 1:
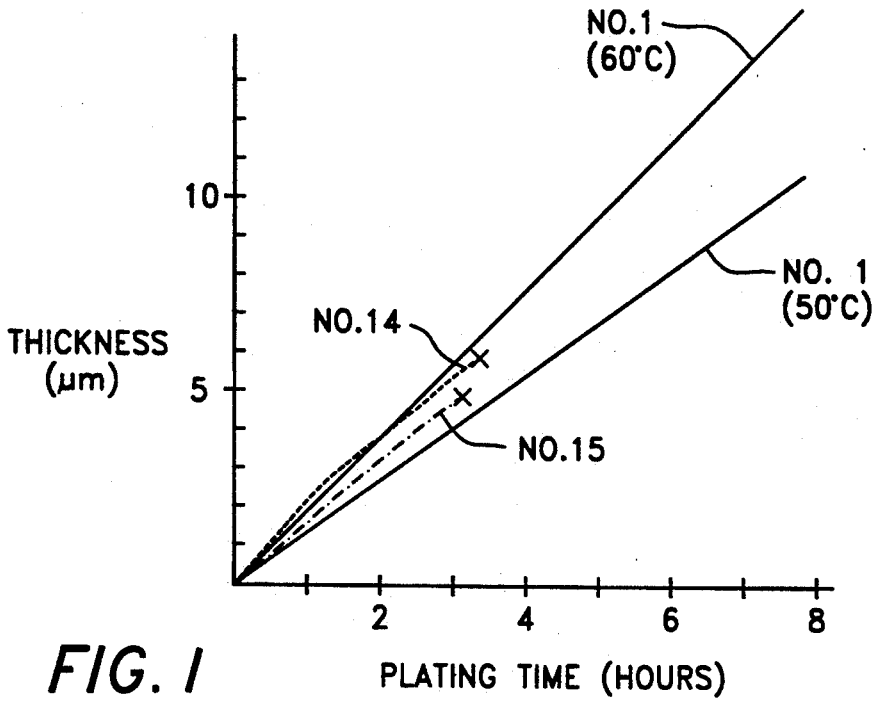
FIG. 1 shows the relation between plating time and thickness of the plating layers formed in a plating bath of the invention (No. 1) and comparative baths (Nos. 14 and 15) respectively.
Figure 2:
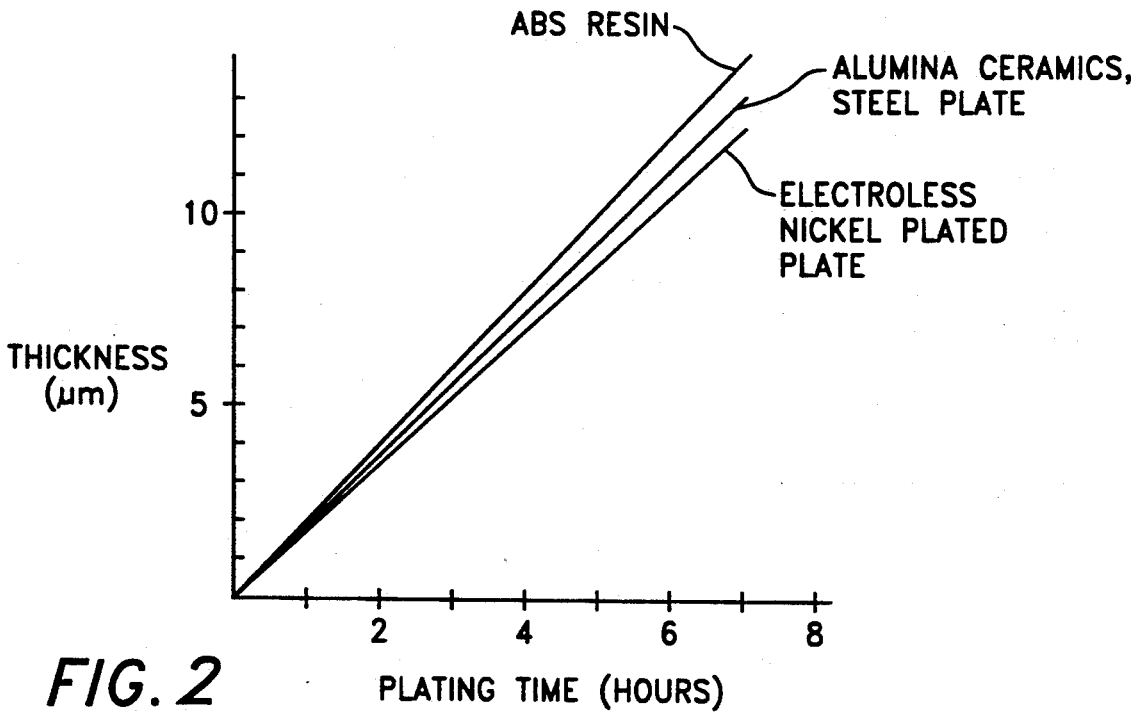
FIG. 2 shows the relation between plating time and thickness of the plating layers deposited on respective materials in a plating bath of the invention.

We claim:

1. An electroless palladium plating composition which comprises (1) 0.001–0.1 mol/l of a palladium compound, (2) 0.01–1 mol/ of a hypophosphite compound (3) 0.01–5 mol/l of at least one member selected from the group consisting of ammonia of alkylamine compounds, (4) 0.01–20 mg/l of high-molecular weight polyethyleneimine having molecular weight of 300 to 100,000 and (5) 0.01–10 g/l of an aliphatic alkylamine, said composition being at a pH in the range of 5–10.

2. The plating composition as defined in claim 1 wherein the palladium compound is at least one member selected from the group consisting of palladium oxide, palladium chloride, palladium nitrate, palladium acetate, sodium palladium chloride, potassium palladium chloride, ammonium palladium chloride, palladium sulfate, tetraammine palladium chloride and dinitrodiammine palladium.

3. The plating composition as defined in claim wherein the hypophosphite compound is at least one member selected from the group consisting of hypophosphorous acid, ammonium hypophosphite, potassium hypophosphite, sodium hypophosphite, lithium hypophosphite and calcium hypophosphite.

4. The plating composition as defined in claim 1 wherein the alkylamine compound is at least one member selected from the group consisting of methylamine, ethylamine, propylamine, dimethylamine, trimethylamine, methylethylamine, isopropylamine, methylenediamine, ethylenediamine, propylenediamine, butylenediamine, dimethylenetriamine, diethylenetriamine, triethylenetetramine, tetraethylenepentamine, pentaethylenehexamine, ethylenediaminetetraacetic acid, diethylenetriaminepentacetic acid, N-hydroxyethylethylenediaminetriacetic acid, nitrilotriacetic acid, alkali metal salts of the above compounds, glycine and N-methylglycine.

5. The plating composition as defined in claim 1 wherein the aliphatic alkenylamine is at least one member selected from the group consisting of monovinylamine, divinylamine, monoallylamine, diallylamine, propenylamine, isopropenylamine, N-monovinylethylenediamine, N-monoallylethylenediamine, N,N'-diallylethylenediamine, N-isopropenylethylenediamine, N-allyldiethylenetriamine, N,N'-diallyldiethylenetriamine and N-vinyltriethylenetetramine.

* * * * *

UNITED STATES PATENT AND TRADEMARK OFFICE

CERTIFICATE OF CORRECTION

PATENT NO. : 5,292,361

DATED : March 8, 1994

INVENTOR(S) : Kuniaki Otsuka, et. al.

It is certified that error appears in the above-indentified patent and that said Letters Patent is hereby corrected as shown below:

Column 11, line 31, claim 1- (2), change "0.01-1 mol/ " to -- 0.01 - 1 mol/l--.

Column 11, line 33, claim 1 - (3), change "ammonia of alkylamine compounds" to --ammonia and alkylamine compounds--.

Signed and Sealed this

Thirtieth Day of August, 1994

*Attest:*

*Attesting Officer*

Bruce Lehman

BRUCE LEHMAN

*Commissioner of Patents and Trademarks*